US008650676B2

(12) United States Patent
Lin

(10) Patent No.: US 8,650,676 B2
(45) Date of Patent: Feb. 18, 2014

(54) PATIENT LIFT AND TRANSFER DEVICE

(76) Inventor: Tsung-Yi Lin, Yongkang (TW)

( * ) Notice: Subject to any disclaimer, the term of this patent is extended or adjusted under 35 U.S.C. 154(b) by 383 days.

(21) Appl. No.: 12/914,239

(22) Filed: Oct. 28, 2010

(65) Prior Publication Data

US 2011/0138532 A1 Jun. 16, 2011

(30) Foreign Application Priority Data

Dec. 16, 2009 (CN) ..... 2009 1 0252765

(51) Int. Cl.
*A61G 7/10* (2006.01)

(52) U.S. Cl.
USPC ..... 5/87.1; 5/81.1 HS; 5/84.1; 5/86.1

(58) Field of Classification Search
USPC ..... 5/81.1 R, 83.1, 87.1, 86.1, 81.1 HS, 5/84.1; 414/921
See application file for complete search history.

(56) References Cited

U.S. PATENT DOCUMENTS 1,620,298 A * 3/1927 Smith ..... 5/86.1
2,375,907 A * 5/1945 Farmer ..... 5/86.1
2,375,908 A * 5/1945 Farmer ..... 5/86.1
2,962,730 A * 12/1960 Carnes et al. ..... 5/86.1
3,938,820 A * 2/1976 Nabinger ..... 280/47.11
4,704,749 A * 11/1987 Aubert ..... 5/87.1
8,316,480 B2 * 11/2012 Burak et al. ..... 5/87.1

FOREIGN PATENT DOCUMENTS

DE G 8700016 U1 4/1987
WO WO 94/27545 12/1994
WO WO 2009/076630 6/2009

OTHER PUBLICATIONS

European Search Report issued for corresponding European application 10013594 dated Nov. 2, 2011.

* cited by examiner

*Primary Examiner* — Nicholas Polito
(74) *Attorney, Agent, or Firm* — Frommer Lawrence & Haug LLP; Ronald R. Santucci

(57) ABSTRACT

A patient lift and transfer device includes a base with casters for moving on a ground surface, a mast extending upwardly from the base, a carriage guided to slide along the mast by a mechanical linear drive assembly and having a forwardly extending beam, and a resting module for a patient to sit or lie thereon. The resting module is detachably connected to the beam to be suspended from the ground surface, and is raised or lowered with the carriage so as to lift and transfer the patient in a safe and comfortable manner.

15 Claims, 10 Drawing Sheets

PATIENT LIFT AND TRANSFER DEVICE

CROSS-REFERENCE TO RELATED APPLICATION

This application claims priority of Chinese Patent Application No. 200910252765.3, filed on Dec. 16, 2009, the disclosure of which is herein incorporated by reference.

BACKGROUND OF THE INVENTION

1. Field of the Invention

This invention relates to a lift and transfer device, more particularly to a patient lift and transfer device which is used to lift and transfer a physically disabled patient to a wheelchair, a gurney, a commode, or a car seat.

2. Description of the Related Art

Referring to FIG. 1, a conventional patient lift is shown to include a rectangular base 11, a plurality of castors 12 for facilitating movement of the patient lift over a ground surface, a mast 13 extending rearwardly and upwardly from the base 11, two handles 14 securedly mounted on the mast 13, a lifting arm 15 which is pivotally mounted on and which extends forwardly from the mast 13 to terminate at a lifting end 151, an actuator 16, such as a hydraulic cylinder, coupled to the mast 13 and the lifting arm 15, and a fabric-made sling 17 coupled to the lifting arm 15 by virtue of a sling attachment 171. The actuator 16 is used to move the lifting arm 15 between a lowered position in which a patient sitting in the sling 17 can be lowered onto or lifted off a seat, a bed, etc., and a raised position in which the patient is suspended in the sling 17.

Since the sling 17 of this conventional patient lift is used with the lifting arm 15 for suspending the patient, the following drawbacks arise:

1. Since the hydraulic cylinder is used as the actuator, the lifting arm 15 is moved and stopped abruptly, thereby rendering swinging movement of the sling 17 unsteadily and making the patient uncomfortable.

2. Since the fabric-made sling 17 is wrapped around the patient, the patient may feel very uncomfortable on his/her back and legs, and may feel undignified when suspended in the sling 17.

3. A skilled and experienced operator is required to rapidly and safely wrap the sling 17 around the patient.

SUMMARY OF THE INVENTION

An object of the present invention is to provide a patient lift and transfer device which has a resting module for a patient to sit or lie thereon and which can hoist the patient steadily and safely without swinging of the resting module so that the patient may feel relatively comfortable.

According to this invention, the patient lift and transfer device includes a base provided with casters for moving on a ground surface, a mast and a guiding post which extend in an upright direction from the base and which are spaced apart from each other in a longitudinal direction, a carriage including a carriage body which is sleeved on and linearly displaceable relative to the mast, a beam which extends cantileveredly and forwardly from the carriage body, and a guided member which extends from the carriage body and which is in slidable engagement with the guiding post, a mechanical linear drive assembly disposed to drive movement of the carriage body along the mast, and a resting module including a major wall which extends in the longitudinal direction to terminate at proximate and distal sides, and which has an insert slot that is configured to permit the beam to be detachably engaged therein to thereby suspend the major wall from the ground surface. A patient may sit or lie on the resting module and may be lifted with movement of the carriage by operation of the mechanical linear drive assembly so as to be steadily and smoothly transported.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
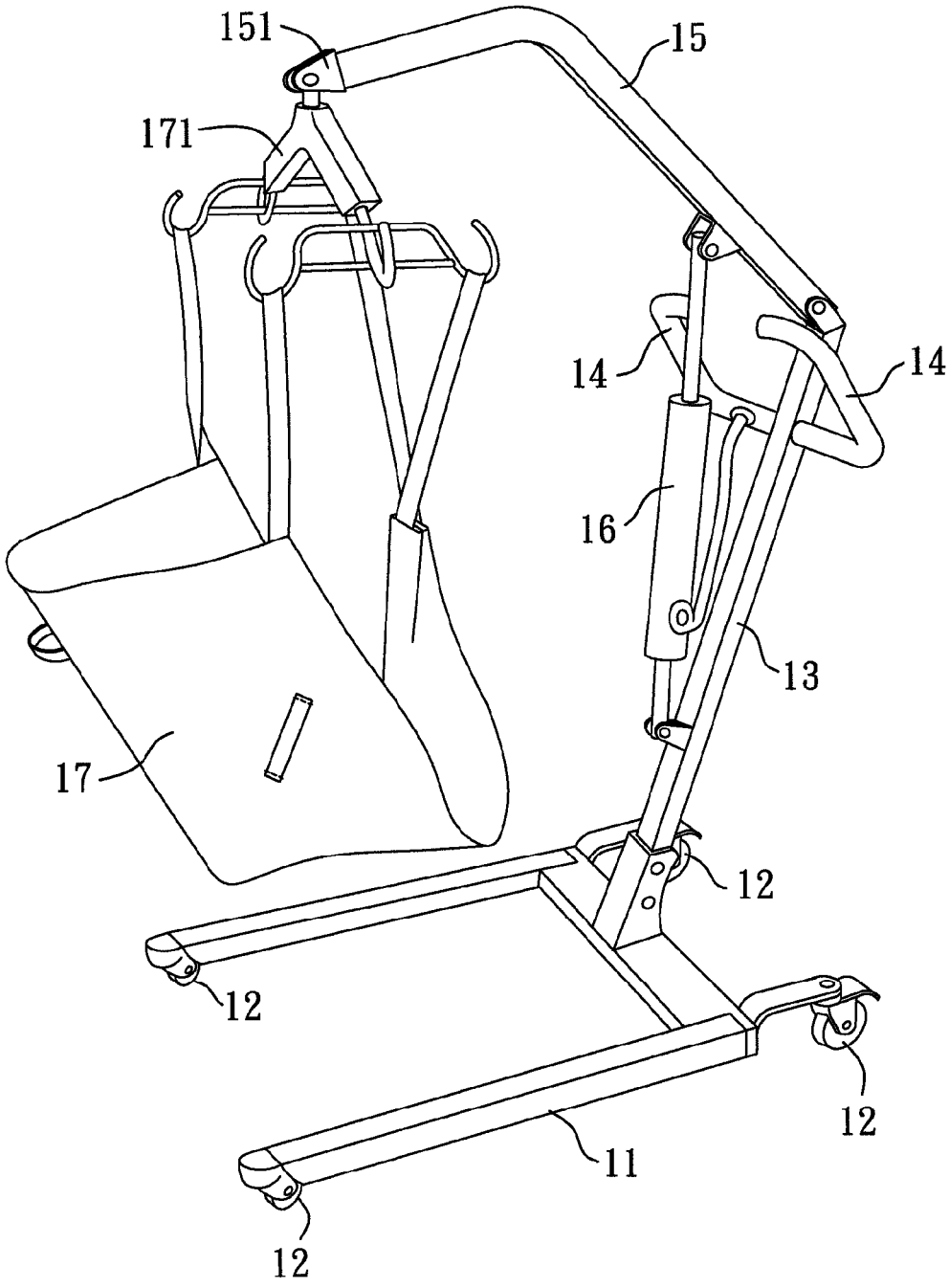
FIG. 1 PRIOR ART
FIG. 1 is a perspective view of a conventional patient lift.

Before the present invention is described in greater detail, it should be noted that same reference numerals have been used to denote like elements throughout the specification.

Referring to FIGS. 2 to 5, the first preferred embodiment of a patient lift and transfer device according to the present invention is shown to comprise a base 2, a frame 3, a carriage 7, a mechanical linear drive assembly 4, a resting unit 5, and a chest guard module 6.

The base 2 includes a base body 21 having two casters 24 resiliently mounted thereon, two foldable front base legs 22 extending forwardly from the base body 21 and respectively provided with two casters 221, and two foldable rear base legs 23 extending rearwardly from the base body 21 and respectively provided with two casters 231. The front base legs 22 are configured to have an extendible length and an adjustable angle. By virtue of the casters 24,221,231, the base 2 can be easily moved over the ground surface, and tilting of the base 2 can be prevented. The base body 21 has two rear tubular adapters 211 spaced apart from each other in a transverse direction, and a front tubular adapter 212 spaced apart from the rear tubular adapters 211 in a longitudinal direction.

The frame 3 includes a mast 32 which is connected to the front tubular adapter 212 and which extends along a lengthwise axis in an upright direction to terminate at an upper coupling end 320, two guiding posts 31 which are respectively connected to the rear tubular adapters 211, which extend upwardly to terminate respectively at two handgrips 311 for gripping by an operator to move the device over the ground surface, and which are connected by a crosspiece 312, and a connecting bracket 33 which is disposed to couple the mast 32 and the guiding posts 31. The upper coupling end 320 may be configured to be tubular, and is telescopically fitted and secured to the mast 32 by means of a fastener 324.

The carriage 7 includes a carriage body 71, two mounts 74, two beams 72, and two guiding members 73. The carriage body 71 is sleeved on and is linearly displaceable relative to the mast 32 between raised and lowered positions. The mounts 74 are mounted respectively on two sides of the carriage body 71 by means of a fastening member 75 and respectively have two insert slots 741. Each of the beams 72 has an insert end 721 inserted into the respective insert slot 741 so as to extend cantileveredly and forwardly from the carriage body 71. The guided members 73 are integrally formed with and extend rearwardly from the carriage body 71 in the longitudinal direction, and are in slidable engagement with the guiding posts 31, respectively.

The mechanical linear drive assembly 4 is disposed to drive movement of the carriage 7 in the upright direction, and may be configured to be manually or electrically operated. In this embodiment, the mechanical linear drive assembly 4 is manually operated, and includes a force output member 41, a rotary shaft 43, and a rotation-translation conversion mechanism 42.

The force output member 41 includes first and second tubular bodies 411 which are sleeved on the mast 32 and which are coupled to and movable with the carriage 7, first and second friction flanges 412 which extend respectively and radially from the first and second tubular bodies 411, and a housing 413 which is connected to the carriage 7 and which is disposed to receive the first and second tubular bodies 411 so as to permit the force output member 41 to move linearly with the carriage body 71 in the upright direction for raising or lowering the carriage 7.

The rotary shaft 43 extends along a revolving axis that is radial to the lengthwise axis, and has a handle 432 which is manually operable to make a first rotary motion about the revolving axis.

The rotation-translation conversion mechanism 42 is disposed to convert the first rotary motion of the rotary shaft 43 to a linear motion of the force output member 41. The mechanism 42 includes a bevel gear 420 mounted on and rotated with the rotary shaft 43 about the revolving axis, a bevel rim 426 configured to be meshed with the bevel gear 420 and to make a second rotary motion about the lengthwise axis of the mast 32, and a force coupling subassembly which is disposed to couple the bevel rim 426 to the force output member 41 such that a revolving force of the second rotary motion of the bevel rim 426 is imparted to the force output member 41 to move the carriage 7 linearly in the upright direction.

Specifically, the force coupling subassembly includes an externally threaded region 321 disposed on an outer surface of the mast 32, a hub 423 which is disposed radially opposite to the bevel rim 426, which is sandwiched between the first and second tubular bodies 411, and which has an internally threaded surface 425 that is threadedly engaged with the externally threaded region 321 so as to permit threaded movement of the hub 423 about the lengthwise axis when the bevel rim 426 makes the second rotary motion, and a surrounding friction wall 421 which is interposed radially between the bevel rim 426 and the hub 423 and which has upper and lower friction surfaces 4211,4212 respectively confronting the first and second friction flanges 412, a first anti-friction bearing 422 disposed between the first friction flange 412 and the upper friction surface 4211, and a second anti-friction bearing 422 disposed between the second friction flange 412 and the lower friction surface 4212. By means of the force coupling subassembly, a translation component of the threaded movement of the hub 423 can be transmitted to the force output member 41.

The mechanical linear drive assembly 4 further includes a bracket 431 disposed to be suspended from the carriage 7 and among the carriage body 71 and the guided members 73 such that the rotary shaft 43 is rotatably mounted on the bracket 431, and a third anti-friction bearing 433 disposed between the bracket 431 and the rotary shaft 43 for facilitating rotation of the rotary shaft 43.

In this embodiment, the resting assembly 5 includes a resting module 51, a locking unit 55, and a backrest module 52. The resting module 51 is in the form of a seat which has a major wall 512 for a patient to sit thereon. The major wall 512 extends in the longitudinal direction to terminate at proximate and distal sides 5121,5122, and has two insert slots 513. Each of the insert slots 513 extends in the longitudinal direction through the proximate and distal sides 5121,5122 and is configured to permit a respective one of the beams 72 to be detachably inserted therein from the proximate side 5121 and to reach the distal side 5122 to thereby suspend the major wall 512 from the ground surface. Preferably, the major wall 512 has an inner peripheral wall 518 defining a central hole 517 and having a plurality of engaging studs 519 disposed thereon. An auxiliary seat 54 has a plurality of engaging holes 541 for engagement with the engaging studs 519 such that the auxiliary seat 54 is detachably mounted in the central hole 517.

Preferably, the front base legs 22 are configured to extend forwardly of the distal side 5122 of the resting module 512, and the rear base legs 23 are configured to extend rearwardly of the handgrips 311 so as to ensure safe movement of the device.

The locking unit 55 includes two locking levers 551 which are pivotably and respectively mounted on the mounts 74 of the carriage 7 by two pivot pins 552 such that, by pressing an end 554 of each locking lever 551, the other end 553 of the locking lever 551 is moved upwardly to be retained in a retaining slot 510 formed in the resting module 51.

Figure 2:
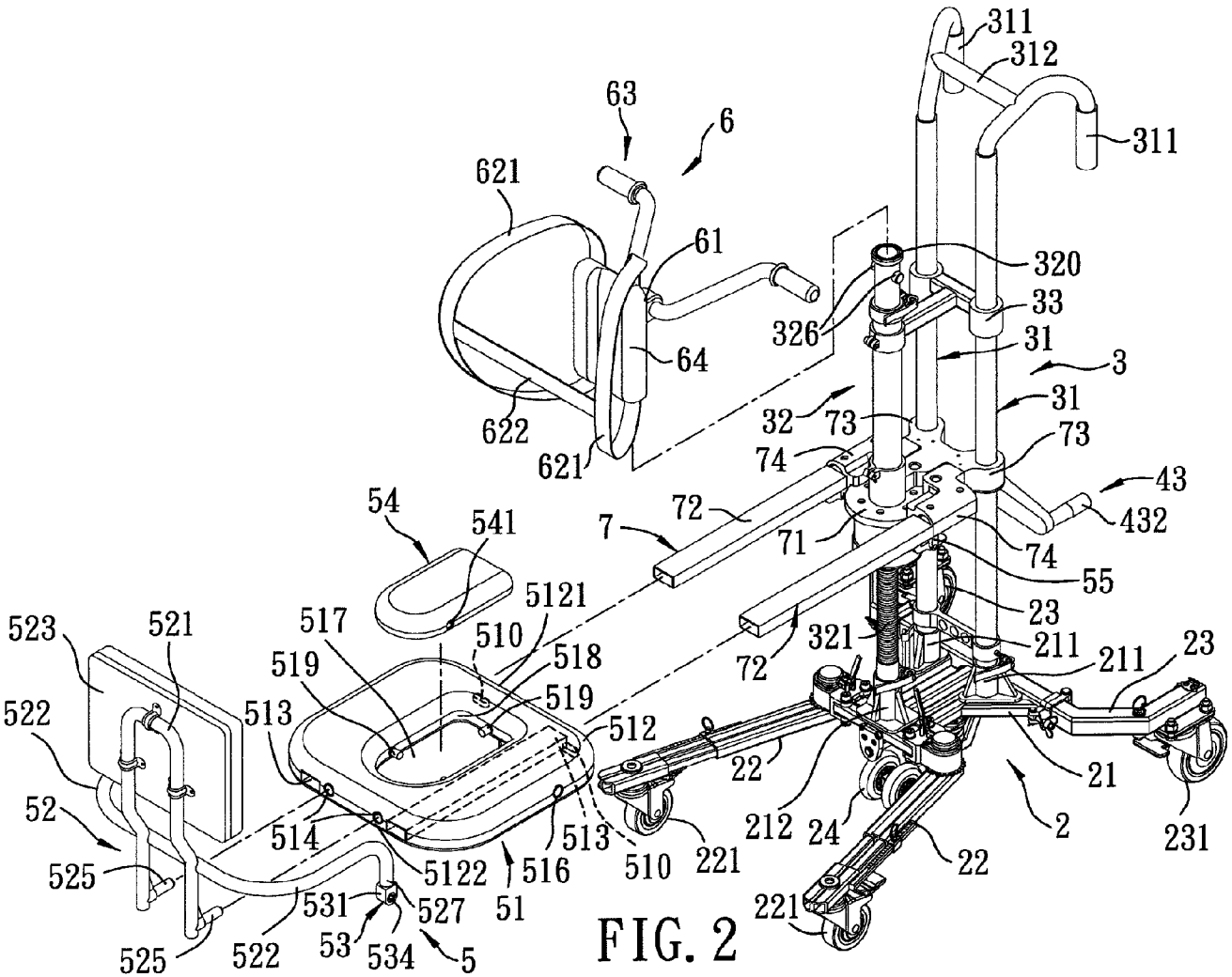
FIG. 2 is an exploded perspective view of the first preferred embodiment of a patient lift and transfer device according to this invention.
Figure 3:
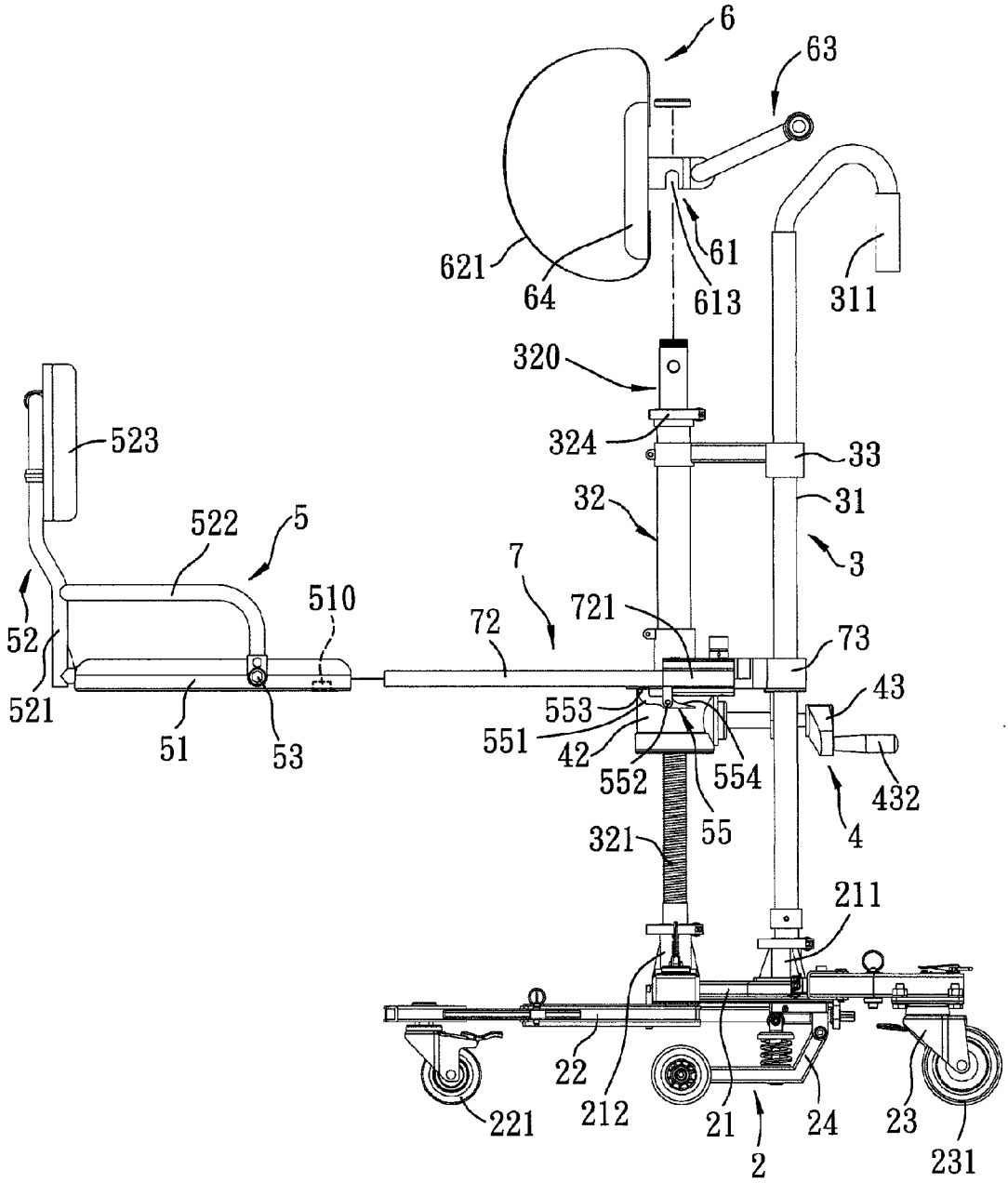
FIG. 3 is an exploded side view of the first preferred embodiment.
Figure 4:
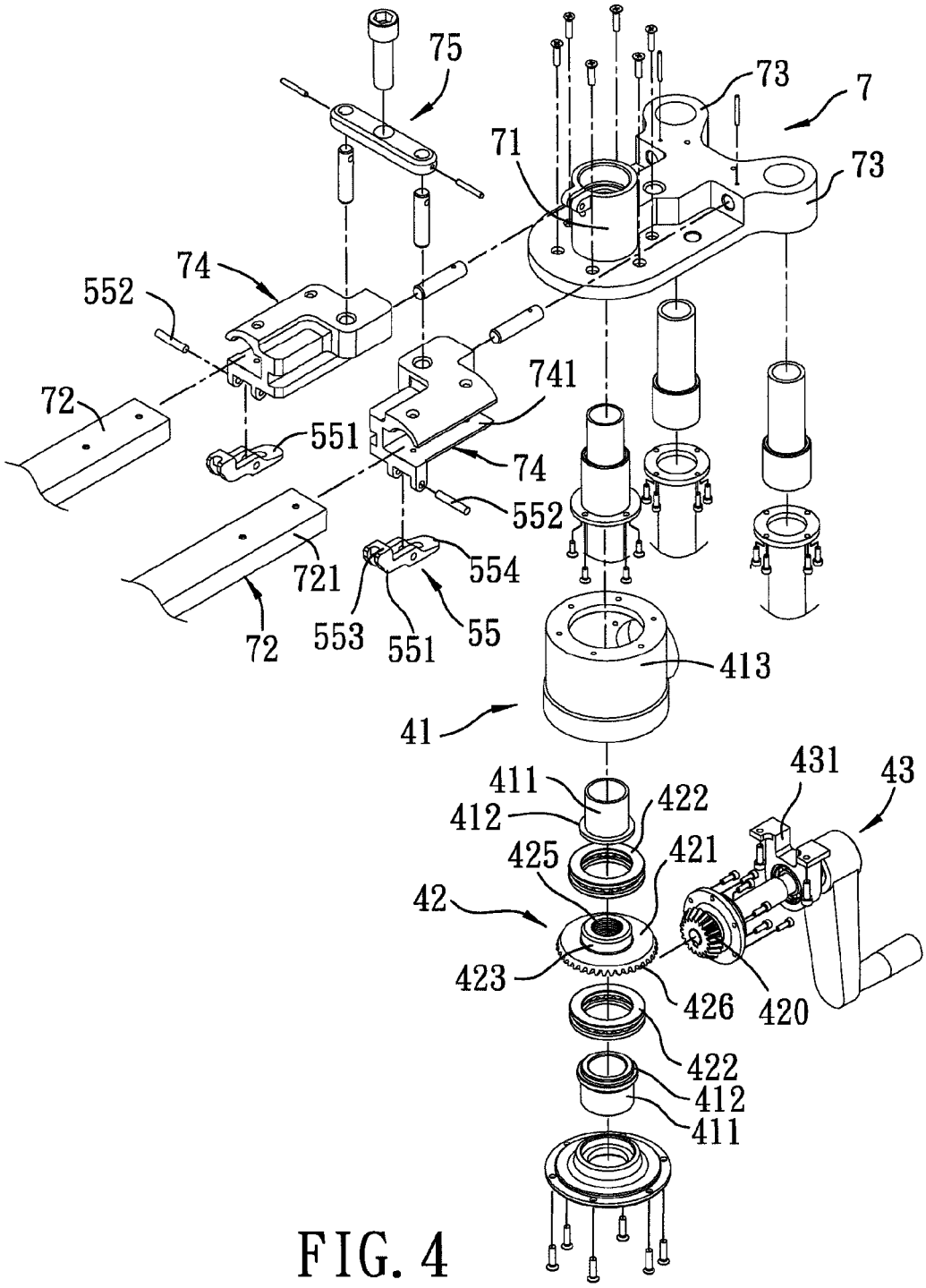
FIG. 4 is a fragmentary exploded perspective view of a carriage and a mechanical linear drive unit of the first preferred embodiment.
Figure 5:
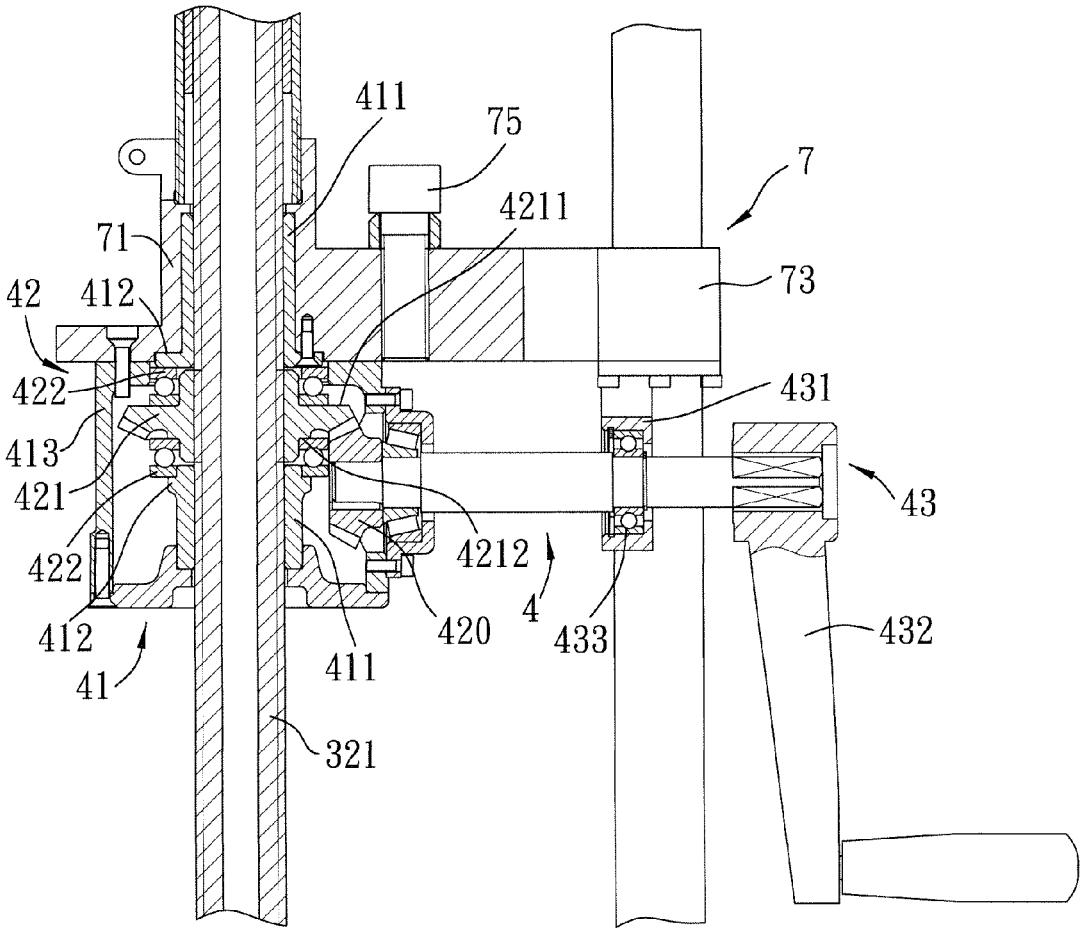
FIG. 5 is a sectional view of the mechanical linear drive unit of the first preferred embodiment.
Figure 6:
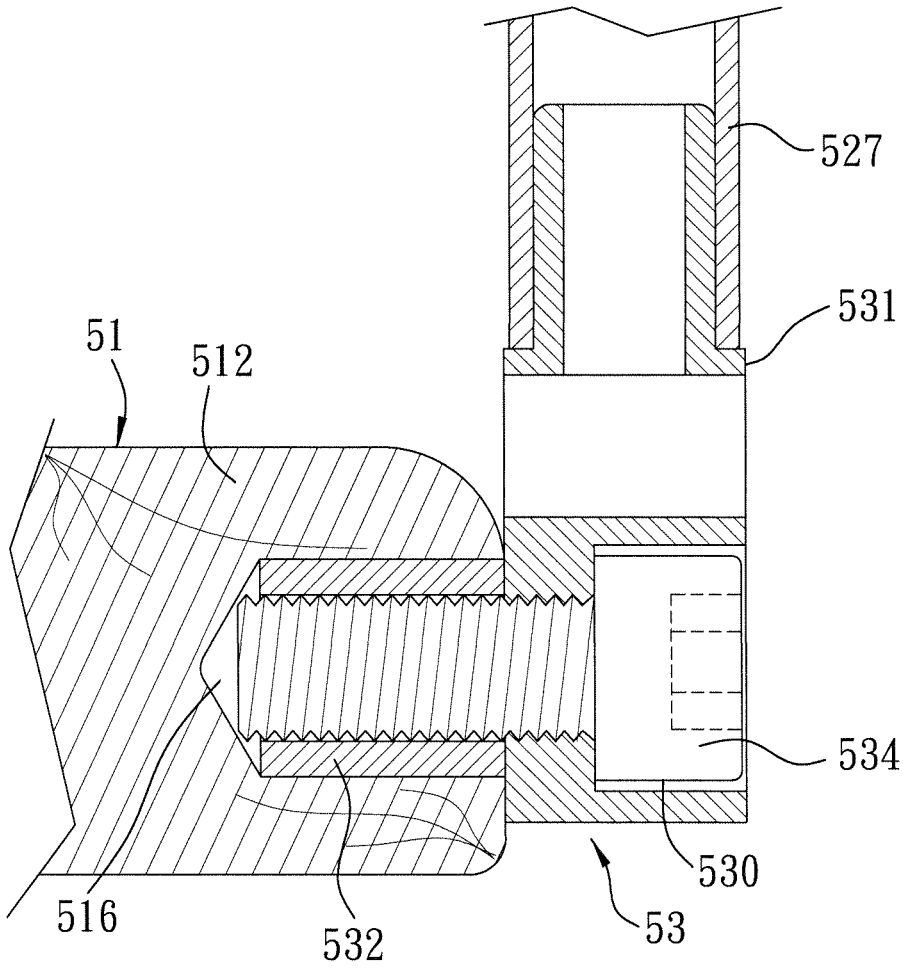
FIG. 6 is a fragmentary sectional view of a resting module of the first preferred embodiment.

Referring to FIGS. 2, 3 and 6, the backrest module 52 is detachably mounted on the distal side 5122 of the major wall 512. Specifically, the backrest module 52 includes an inverted U-shaped frame 521, two lateral arms 522 extending rearwardly from the frame 521 to terminate respectively at connecting portions 527, a padding 523 securely mounted on the frame 521, and two insert stems 525 disposed respectively on two lower ends of the frame 521 and extending rearwardly to be inserted respectively into two insert grooves 514 formed in the distal side 5122. Each of the connecting portions 527 is fastened to a respective lateral side of the major wall 512 by means of a fastening unit 53. The fastening unit 53 includes a mount 531 having a counter bore 530 which is aligned with a lateral hole 516 in the respective lateral side of the major wall 512, and a threaded bolt 534 disposed to be inserted into the counter bore 530 and a frictional member 532 that is mounted in the lateral hole 516.

Referring to FIGS. 2 and 3, the chest guard module 6 is detachably engaged with the upper coupling end 320 of the mast 32. In this embodiment, the chest guard module 6 includes a base mount 61 having a notch 613 to engage two pins 326 formed on the upper coupling end 320, a handle 63 mounted on and extending rearwardly from the base mount 61, a chest pad 64 disposed forwardly of the base mount 61, two shoulder straps 621 which are connected to the chest pad 64, and a connecting strap 622 interconnecting the shoulder straps 621.

When it is desired to transfer a patient from a gurney to a wheelchair or a car seat, the resting module 51 is first placed on the gurney for the patient to be seated thereon. The handle 432 is then operated to move the beams 72 in the upright direction to be aligned with the insert slots 513, respectively. The frame 3 is subsequently moved near the resting module 51, and the beams 72 are respectively inserted into the insert slots 513 and locked thereto by operating the locking levers 551. Thus, the resting module 51 is firmly connected to the carriage 7.

Subsequently, the shoulder straps 621 are respectively wrapped around the patient's shoulders. By virtue of the chest guard module 6 and the backrest module 52, the patient can be steadily supported on the resting module 51. Thereafter, the handle 432 is operated to raise the resting unit 5, and the device is moved over the ground surface to the wheelchair or the car seat. Next, the carriage 7 is lowered to place the resting unit 5 on the wheelchair or the car seat, and the locking unit 55 is then unlocked to permit detachment of the resting unit 5 from the carriage 7. The frame 3 is then moved away from the resting unit 5, and the transfer of the patient is completed. Thus, a health care worker can easily move a patient in a smooth and steady manner.

Figure 7:
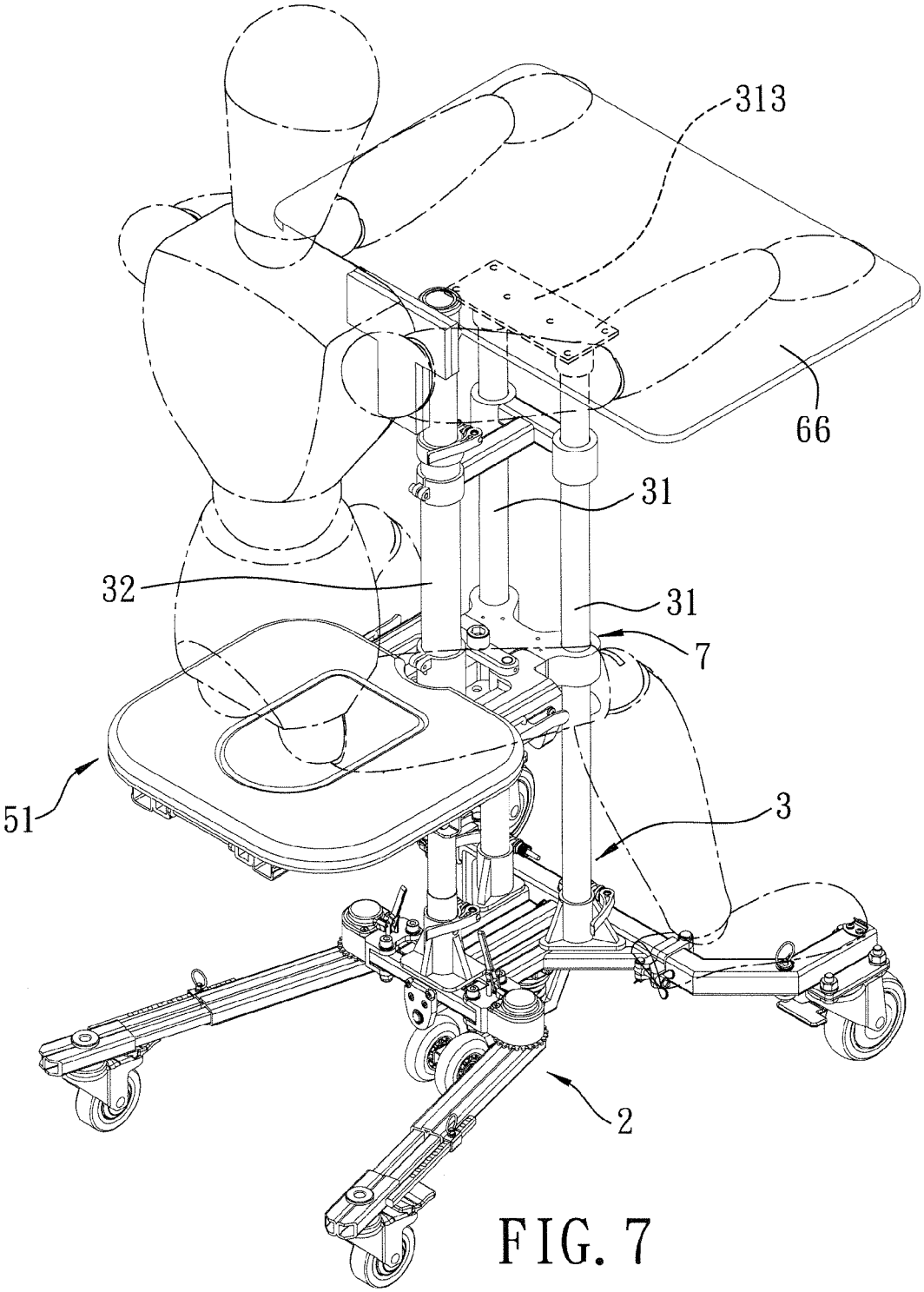
FIG. 7 is a perspective view of the second preferred embodiment of a patient lift and transfer device according to this invention.
Figure 8:
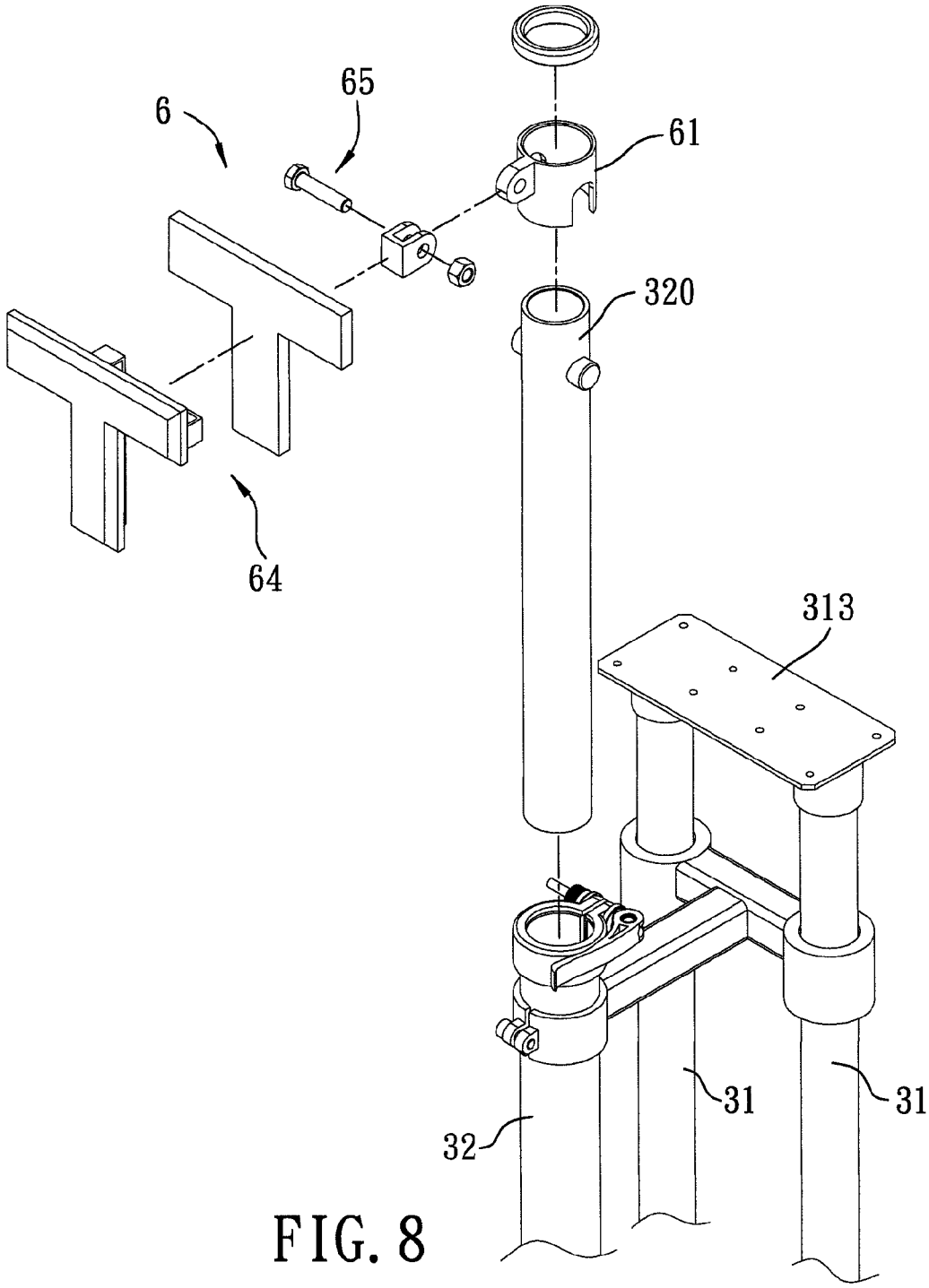
FIG. 8 is an exploded perspective view of a portion of the second preferred embodiment.

Referring to FIGS. 7 and 8, the second preferred embodiment of a patient lift and transfer device according to this invention is similar to the previous embodiment in construction. In the second embodiment, the chest guard module 6 includes a base mount 61 disposed to rest on the upper coupling end 320 of the mast 32, a chest guard body 64 disposed forwardly of the base mount 61, and a tabletop 66 mounted on top ends 313 of the guiding posts 31. Thus, a patient seated on the resting module 51 can place his/her arms on the tabletop 66 during the transfer process.

Figure 9:
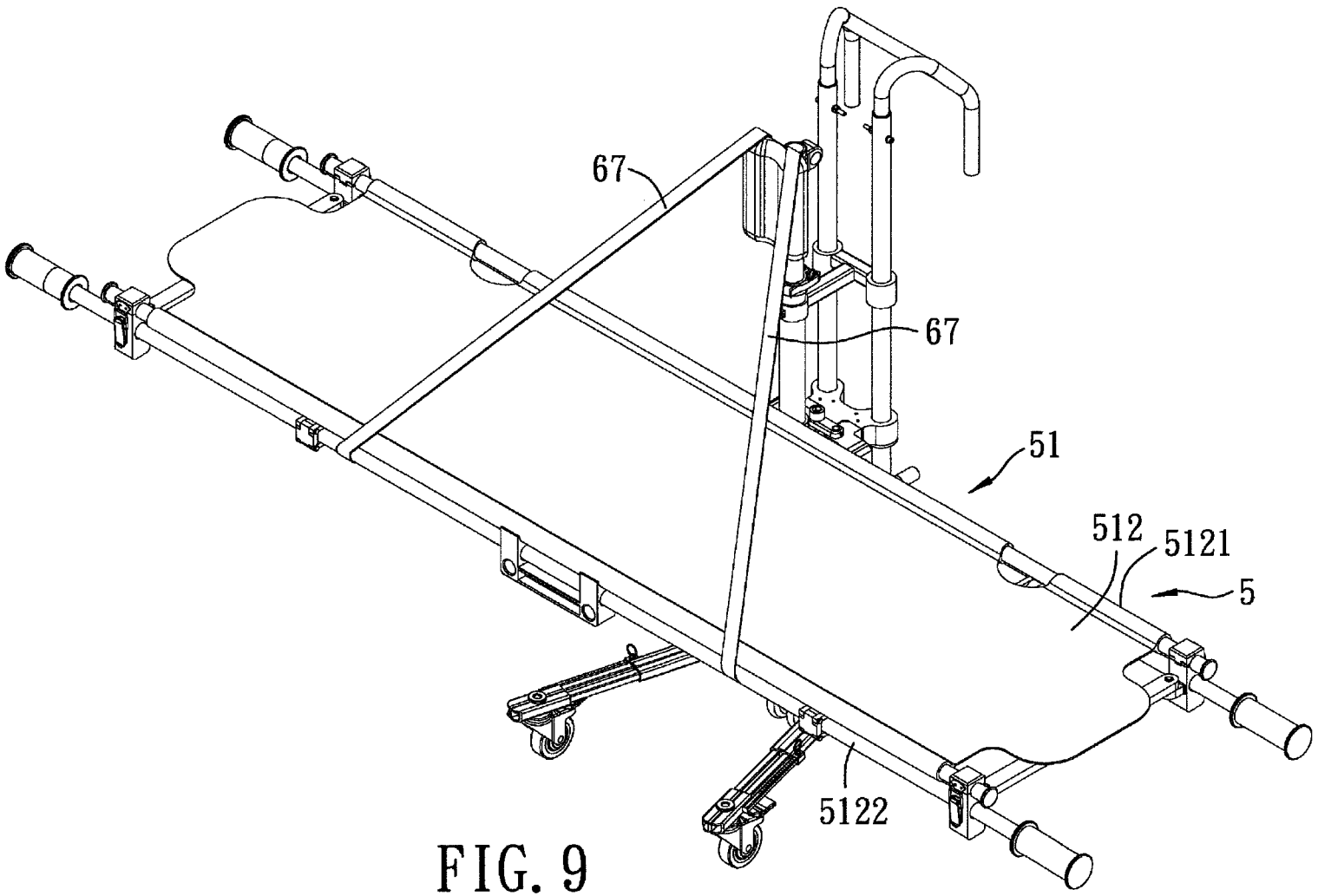
FIG. 9 is a perspective view of the third preferred embodiment of a patient lift and transfer device according to this invention.
Figure 10:
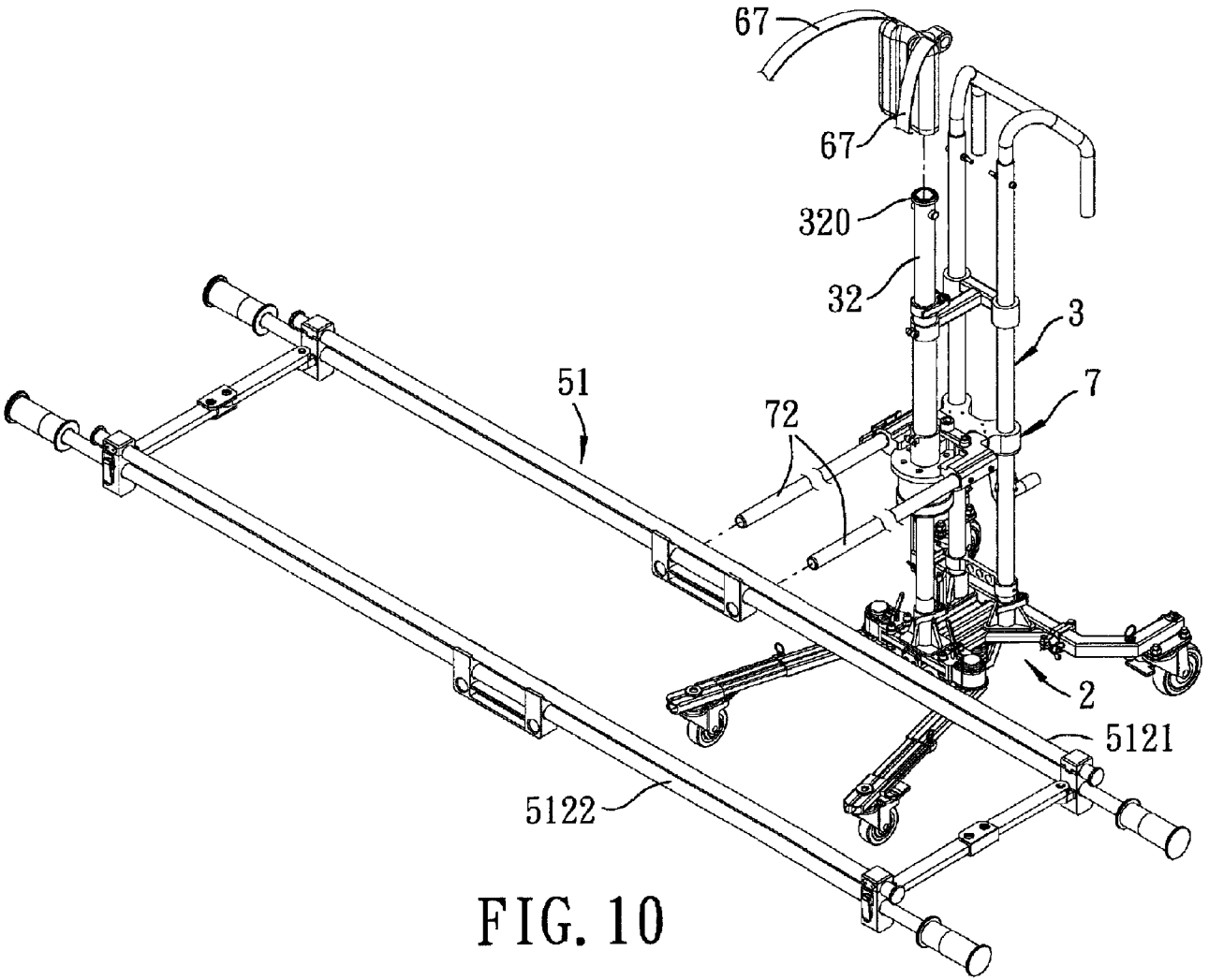
FIG. 10 is a fragmentary perspective view of the third preferred embodiment.

Referring to FIGS. 9 and 10, the third preferred embodiment of a patient lift and transfer device according to this invention is similar to the previous embodiments in construction. In the third embodiment, the resting module 51 is in the form of a stretcher 51 having a rectangular major wall 512 for a patient to lie thereon. Instead of the chest guard module 6, the device comprises two holding straps 67 which are connected to the distal side 5122 of the major wall 512 and the upper coupling end 320 of the mast 32 for holding the stretcher 51.

As illustrated, since the resting module 51 is retainingly connected to the carriage 7 and is lifted by means of the mechanical linear drive assembly 4 along the mast 32, a patient can be securely supported on the resting module 51 and can be smoothly and steadily lifted and transported. Moreover, since the resting module 51 is rigid, the patient seated or lying thereon can feel safer and more comfortable.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A patient lift and transfer device comprising:

a base which is provided with a plurality of casters for moving on a ground surface;

a mast which extends from said base along a lengthwise axis in an upright direction to terminate at an upper coupling end;

a guiding post which extends from said base in the upright direction, and which is spaced apart from said mast in a longitudinal direction transverse to the upright direction;

a carriage including a carriage body which is sleeved on and linearly displaceable relative to said mast between raised and lowered positions, a beam which extends cantileveredly and forwardly from said carriage body, and a guided member which extends from said carriage body in the longitudinal direction, and which is in slidable engagement with said guiding post, said carriage body being disposed in the longitudinal direction between said beam and said guided member;

a mechanical linear drive assembly which is disposed to drive movement of said carriage body in the upright direction;

a resting module including a major wall which extends in the longitudinal direction to terminate at proximate and distal sides, and which has an insert slot that extends through said proximate side in the longitudinal direction, and that is configured to permit said beam to be detachably engaged therein to thereby suspend said major wall from the ground surface; and a rotary shaft located in a space between said guiding post and said mast to drive said mechanical linear drive assembly.

2. The patient lift and transfer device according to claim 1, wherein said rotary shaft extends along a revolving axis which is radial to the lengthwise axis, and is configured to make a first rotary motion about the revolving axis, and wherein said mechanical linear drive assembly includes a force output member configured to move linearly with said carriage body in the upright direction so as to raise or lower said carriage body, and a rotation-translation conversion mechanism which is disposed to convert the first rotary motion of said rotary shaft to a linear motion of said force output member.

3. The patient lift and transfer device according to claim 2, wherein said rotation-translation conversion mechanism includes a bevel gear which is mounted on and rotated with said rotary shaft about the revolving axis, a bevel rim configured to be meshed with said bevel gear and to make a second rotary motion about the lengthwise axis, and a force coupling subassembly which is disposed to couple said bevel rim to said force output member such that a revolving force of the second rotary motion is imparted to said force output member to thereby move said carriage body linearly in the upright direction.

4. The patient lift and transfer device according to claim 3, wherein said force coupling subassembly includes an externally threaded region which is disposed on an outer surface of said mast, a hub which is disposed radially opposite to said bevel rim, and which has an internally threaded surface that is threadedly engaged with said externally threaded region so as to permit threaded movement of said hub about the lengthwise axis when said bevel rim makes the second rotary motion, and a surrounding friction wall which is interposed radially between said bevel rim and said hub, and which is configured to transmit a translation component of the threaded movement of said hub to said force output member.

5. The patient lift and transfer device according to claim 4, wherein said surrounding friction wall has upper and lower friction surfaces;

said force output member including first and second tubular bodies which are sleeved on said mast, which are coupled to and movable with said carriage body, and which flank said hub in the upright direction, and first and second friction flanges which extend respectively and radially from said first and second tubular bodies, and which confront said upper and lower friction surfaces, respectively;

said force coupling subassembly including a first anti-friction bearing which is disposed between said first friction flange and said upper friction surface, and a second anti-friction bearing which is disposed between said second friction flange and said lower friction surface.

6. The patient lift and transfer device according to claim 5, wherein said mechanical linear drive assembly includes a bracket which is disposed to suspend from said carriage and between said carriage body and said guided member such that said rotary shaft is rotatably mounted on said bracket, and a third anti-friction bearing which is disposed between said bracket and said rotary shaft for facilitating rotation of said rotary shaft.

7. The patient lift and transfer device according to claim 1, wherein said insert slot in said resting module is configured to permit said beam to reach said distal side when said beam is inserted thereinto from said proximate side.

8. The patient lift and transfer device according to claim 1, further comprising a locking unit which is disposed to releasably fasten said resting module to said carriage body.

9. The patient lift and transfer device according to claim 1, wherein said guiding post extends upwardly to terminate at a handgrip for gripping by an operator to move said device over the ground surface.

10. The patient lift and transfer device according to claim 1, further comprising a chest guard module detachably engaged with said upper coupling end of said mast.

11. The patient lift and transfer device according to claim 10, wherein said chest guard module includes a base mount which is detachably mounted on said upper coupling end, a chest pad which is disposed forwardly of said base mount, and two shoulder straps which are connected to said chest pad.

12. The patient lift and transfer device according to claim 10, wherein said chest guard module includes a base mount which is detachably mounted on said upper coupling end, a chest guard body which is disposed forwardly of said base mount, and a tabletop which is mounted on a top end of said guiding post.

13. The patient lift and transfer device according to claim 1, wherein said resting module is in the form of a seat which has said major wall for a patient to be seated thereon, said device further comprising a backrest module which is detachably mounted on said distal side of said major wall.

14. The patient lift and transfer device according to claim 1, wherein said resting module is in the form of a stretcher which has said major wall for a patient to lie thereon, said device further comprising two holding straps each of which is connected to said distal side and said upper coupling end for holding said stretcher.

15. The patient lift and transfer device according to claim 1, wherein said base includes a base body which is disposed under said mast and which is provided with two of said casters, two front base legs which extend from said base body and forwardly of said distal side of said resting module and which are respectively provided with two of said casters, and two rear base legs which extend from said base body and rearwardly of said guiding post and which are respectively provided with two of said casters.

* * * * *